US012752947B2

(12) United States Patent
Porta

(10) Patent No.: US 12,752,947 B2
(45) Date of Patent: Oct. 6, 2026

(54) METHOD FOR MAKING AND FILLING POUCHES WITH OR WITHOUT SPOUT FOR PACKAGING FLUID PRODUCTS AND RELATED PLANT

(71) Applicant: Alessandro Porta, Varese (IT)

(72) Inventor: Alessandro Porta, Varese (IT)

(73) Assignee: Alessandro Porta, Varese Va (IT)

( * ) Notice: Subject to any disclaimer, the term of this patent is extended or adjusted under 35 U.S.C. 154(b) by 0 days.

(21) Appl. No.: 19/158,172

(22) PCT Filed: Feb. 28, 2024

(86) PCT No.: PCT/IB2024/051892

§ 371 (c)(1),
(2) Date: Aug. 20, 2025

(87) PCT Pub. No.: WO2024/180486

PCT Pub. Date: Sep. 6, 2024

(65) Prior Publication Data

US 2026/0208901 A1 Jul. 23, 2026

(30) Foreign Application Priority Data

Feb. 28, 2023 (IT) ..... 102023000003531

(51) Int. Cl.
*B65B 43/12* (2006.01)
*B65B 3/04* (2006.01)
(Continued)

(52) U.S. Cl.
CPC ..... *B65B 43/123* (2013.01); *B65B 3/045* (2013.01); *B65B 5/022* (2013.01); *B65B 5/10* (2013.01);
(Continued)

(58) Field of Classification Search
CPC ..... B65B 43/123; B65B 5/10; B65B 3/04; B31B 70/96; B31B 70/84; B31B 70/00
See application file for complete search history.

(56) References Cited

U.S. PATENT DOCUMENTS

| | | | |
|---|---|---|---|
| 9,434,492 | B1 | 9/2016 | Russell et al. |
| 2005/0284105 | A1 | 12/2005 | Glatfelter |

FOREIGN PATENT DOCUMENTS

| | | | |
|---|---|---|---|
| EP | 3674073 | A1 | 7/2020 |
| GB | 1333007 | A | 10/1973 |
| WO | 2006085031 | A1 | 8/2006 |

OTHER PUBLICATIONS

International Search Report and Written Opinion ofInternational PCT Application No. PCT/IB2024/051892; Dated: Jul. 17, 2024.

*Primary Examiner* — Daniel Jeremy Leeds
(74) *Attorney, Agent, or Firm* — Chrisman Gallo Tochtrop LLC

(57) ABSTRACT

A method for making and filling pouches with or without spout. A pouch making step, at a first site, includes: a manufacturing sub-step wherein pouches are manufactured as a continuous strip of two rows wherein the pouches of one row face an opposite direction compared with the adjacent row, and the strip is cut into two semi-strips, then deflected laterally and overlapped; and a packaging sub-step, wherein the overlapping semi-strips pouches are jointly packaged in a zig-zag package or in a roll. A step of transport of the pouch packages from the first site to a second site. A pouch filling step, at the second site, includes: a preparation sub-step wherein the semi-strips of pouches are taken from the package and inserted in a continuous conveyer system; and a singularization and filling sub-step wherein the semi-strips of pouches are cut and divided into individual pouches, filled-up and capped.

13 Claims, 6 Drawing Sheets

(51) Int. Cl.

| | |
|---|---|
| ***B65B 5/02*** | (2006.01) |
| ***B65B 5/10*** | (2006.01) |
| ***B65B 61/18*** | (2006.01) |

(52) U.S. Cl.
CPC ..... *B65B 61/186* (2013.01); *B65B 2220/18* (2013.01)

METHOD FOR MAKING AND FILLING POUCHES WITH OR WITHOUT SPOUT FOR PACKAGING FLUID PRODUCTS AND RELATED PLANT

FIELD OF THE INVENTION

The present invention refers to an improved method for making and filling pouches with or without spout for packaging fluid products, where the definition "fluid products" is intended to indifferently include all liquids, gels, or solid products being in a form that can be introduced in predetermined doses inside a pouch, with or without spout. The invention also relates to a plant for making and filling pouches with or without spout, wherein said method is used.

As well known, pouches with spout are a recent type of packaging for liquids, consisting of two superimposed sheets of a suitable flexible material (e.g. a plastic or paper material), mutually welded at their outer edges and equipped with a spout with cap for introducing a fluid product. The spout is inserted and welded between said two sheets of flexible material, usually at the upper portion of the pouch, and it is provided with a screw or pressure cap. A particular type of spout pouch called "standup" also provides for a third sheet of flexible material—at a pouch bottom portion opposite to the upper portion carrying the spout—which is interposed like a bellows between the two main sheets and welded to them. In the pouch filling step, said third sheet spreads out and thus gives a stable support base to the pouch itself, in an upright position.

Furthermore, single-portion pouches without spout, i.e. pouches intended for rapid and complete consumption of their content after opening, have also been widespread on the market, which pouches share the above-described manufacturing method of the pouches with spout except that the spout is not present. After filling the pouch through a filling port formed in a still unwelded area of the pouch perimeter, the pouch is then welded also in this area and thus liquid-proof sealed.

The above said pouches with or without spout, made of flexible material, have rapidly met the favour of the market thanks to their features of low weight, low cost and an extremely low empty volume compared to other types of non-foldable packaging for fluids.

BACKGROUND OF THE PRIOR ART

Currently known plants for making and filling the above-said pouches of flexible material can be divided into two distinct types depending on whether the pouch manufacturing is implemented in the same site where the pouches are filled with a fluid product or not.

In a first type of so-called integral plants the following steps are provided: a first step of making the pouches starting from sheets of a flexible material, and subsequently possibly inserting and heat-sealing a spout on the partially welded pouch; and a second step of filling the pouch with the desired liquid product and closing it. Integral plants of this type, despite having excellent manufacturing efficiency—considering that they can simultaneously feed one or more filling up stations according to desired packaging sequences of various products—have the drawback of a particularly high plant cost and large footprint. A traditional plant line of this type is in fact at least 15 m long; this length even increases when the most recent types of single-material pouches are treated—preferred due to their better recycling potentiality—which however involve prolonged welding times.

In a second type of so-called compact plants, a third-party specialized manufacturer supplies prefabricated ready-to-use pouches of flexible material already inserted in rail loaders (in the case of pouches with spout) or packaged in cartons (in the case of pouches without spout). This second type of plant has the advantage of not requiring any pouch making plant at the filling site, but also shows some drawbacks such as: high cost of the prefabricated pouches inserted in rail loaders; a certain logistical complexity in feeding the filling up stations, which the operator must in fact feed very frequently, in the order of minutes, since each package of pouches on rail loaders contains a relatively small number of pouches (for example, approximately 50 pouches for each loader); finally, the need to manage the return of empty rail loaders to the prefabricated pouch manufacturer. Furthermore, when repetitive series of pouches containing different fluid products must be filled (for example a few different flavours of juices), planning of a correct feeding of the pouches to the filling up stations becomes particularly complex.

In the context of this second type of plant, it was also proposed to prepare the pouches in a continuous strip format instead of an individual format, to simplify and make more efficient the transport step of the pouches from the manufacturing site to the filling site.

WO-2006/085031 discloses, for example, a method for packaging a fluid product in flexible pouches wherein a continuous strip of flexible pouches arranged in two or more parallel rows is manufactured by overlapping and welding at least two films of suitable flexible material, through subsequent moulding and welding operations. Each pouch is provided with an access opening, suitable for the subsequent insertion and fixing of a spout, and then the strip of said pre-formed pouches is zigzag folded and packaged in a transport box. During the filling step, the continuous strip is unwrapped and fed to a cutting and separating machine which separates the individual pouches through longitudinal and transversal cuts, and then feeds them to a carousel filling up plant wherein said access openings are provided with a spout, and finally the pouches are filled and closed in a traditional manner.

U.S. Pat. No. 9,434,492 discloses a similar method for manufacturing pouches with a bellows base in the form of a continuous, roll-wrapped strip comprising side by side pouches arranged in a longitudinal direction. During the filling step, the roll is unrolled to show its free edge in a vertical position and the pouches are filled via a filling port located in their upper position, before being separated from the continuous strip.

Although the above known methods have theoretically brought about an improvement in the efficiency of pouch transport from manufacturing to filling site, compared to previous methods with rail loaders, their diffusion on the market has been quite negligible. In the practical application of these methods of making pouches in the form of a continuous strip, two significant drawbacks have been encountered which prevented their diffusion on the market. A first drawback comes from the fact that every type of pouch always shows significant thickness variations across its different parts, both due to the presence of a different number of film layers (for example in the base or top areas, when these areas are bellows-shaped) and to the presence of accessories for filling up and/or closing the pouch, such as indeed a spout or a spout support base. When these strips of pouches are packaged for transport, these thickness variations randomly overlap, thereby making the package highly irregular and unstable, both in the zigzag folded format and in the roll-wrapped format. Said irregularities and instability of the obtained strip packages cause corresponding difficulties at the filling site in achieving a regular deployment of the strip from the box packages, as well as in pouch deformations which can cause irregularities or jams in the subsequent filling step.

A second drawback of the afore-said known methods are the technical complexity and excessive cost of an apparatus which performs, at the filling site, the mechanical operations of cutting the strip both in a longitudinal and a transversal direction to separate the individual pouches from the strip. Additionally, when this operation is implemented before the filling step, as disclosed in WO-2006/085031, the individual pouches resulting from the cutting operation must be moved along the plant, when they no longer have a common dragging support; on the other hand, when the cutting and separation operations are implemented after filling the pouches, as disclosed instead in U.S. Pat. No. 9,434,492, in addition to the complication of cutting the strip in two orthogonal directions there also is the inconvenience of operating on pouches already full of fluid and therefore no longer flat.

The technical problem addressed by the present invention is therefore that of offering an improved method for making and filling pouches with and without spout, which overcomes the drawbacks of the known methods discussed above and, in particular, which can be implemented in a plant with a footprint comparable to that of the compact plants described above, while presenting a high efficiency in feeding the pouch filling up stations which instead is currently typical of integral plants.

Within the scope of this technical problem, a first object of the present invention is to provide a method for making pouches in continuous strip packages having high stability and regularity.

A second object of the invention is also to provide a method for making pouches in continuous strip packages, which allows easy automatic removal of the pouches from the packages and simultaneously minimizes the pouch cutting and separation operations to be implemented at the filling site.

SUMMARY OF THE INVENTION

These objects are achieved by means of a method for making and filling pouches with and without spout, having the features defined in claim 1, and of a plant which implements such method, having the features defined in claim 7. Other preferred features of such method and plant are defined in the secondary claims.

BRIEF DESCRIPTION OF THE DRAWINGS

Further features and advantages of the method for making pouches with and without spout according to the present invention will anyhow become more evident from the following detailed description of preferred embodiments of the same, given by mere way of non-limiting example and illustrated in the accompanying drawings, wherein.

DETAILED DESCRIPTION OF THE PREFERRED EMBODIMENTS

Figure 1:
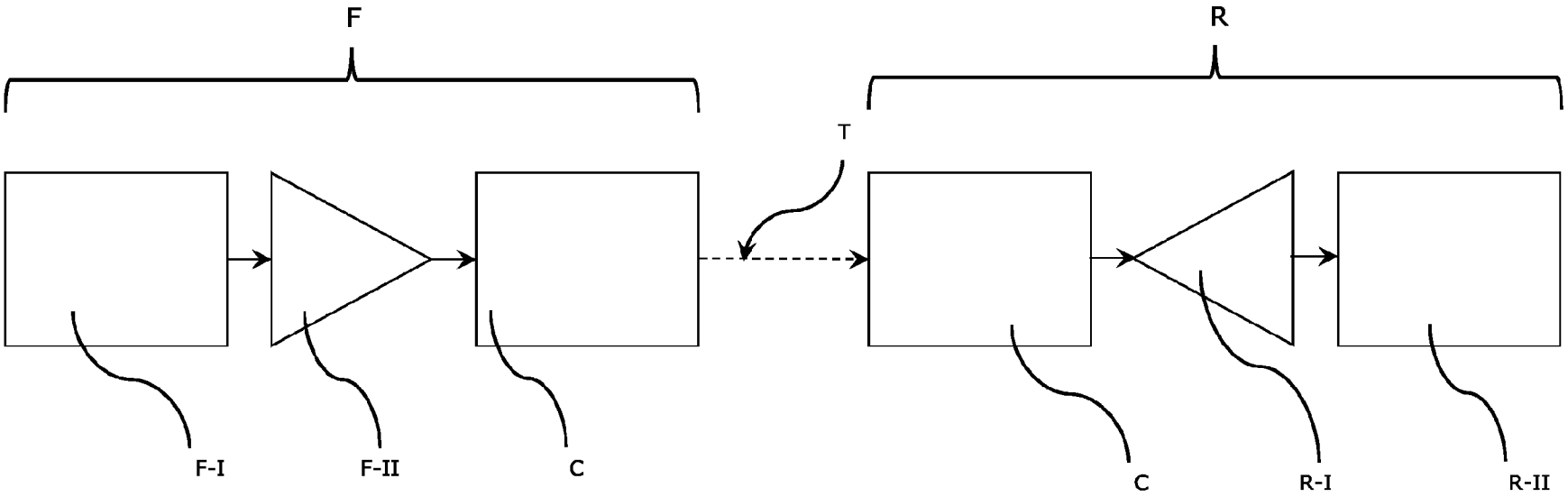
FIG. 1 is a block diagram illustrating the main steps of a method for making and filling pouches for a compact filling plant, to which the method and plant according to the present invention are aimed.

According to the present invention, in order to solve the problem highlighted above with a simple construction and easy to apply solution, the inventor assumed to make a substantial improvement to the known methods for making and filling pouches applied in the so-called compact plants described above, by radically modifying the pouch making and packaging step, in order to acquire then clear advantages in the subsequent steps of transport and filling of the pouches themselves. Some additional processing steps provided by the method of the invention, immediately upstream of the pouch filling step, involve only a modest lengthening and a minimal complication of said compact plant compared to those currently in use, while the manufacturing efficiency of a compact plant modified according to this method significantly increases, thereby becoming comparable to that of an integral plant.

In accordance with a first main feature of the method for making and filling pouches of the present invention, the pouches—rather than in the known configurations of individual pouches on a rail loader or of continuous strip containing multiple rows of pouches all facing the same direction—are in fact formed by the manufacturer in an innovative configuration consisting in a continuous strip of two rows of pouches wherein the pouches of one row are facing in an opposite direction compared with the pouches of the adjacent row, i.e. rotated by 180° in the plane of said continuous strip. The pouches of the continuous strip are also at least partially mutually joined, both in correspondence with a centreline of said continuous strip of pouches, and in correspondence with the transversal lines separating adjacent pouches of each single row of pouches.

In accordance with a second main feature of the method for making and filling pouches of the present invention, the thus formed strip of pouches is then longitudinally cut along its centreline and the two semi-strips thus obtained are mutually overlapped and then jointly packaged according to two different packaging methods, namely:

1) in a first embodiment, the two semi-strips of opposite pouches are jointly arranged in a parallelepiped container, such as for example a cardboard box, in successive superimposed layers, in an alternate zigzag direction;
2) in a second embodiment, instead, the two semi-strips of pouches facing in opposite directions are jointly wrapped into a roll on a cylindrical core, which core is preferably made of pressed cardboard.

The above said pouch strip configuration comprising only two rows of pouches facing in opposite directions, can obviously also be identically reproduced in "multiple" strips, i.e. containing two or more adjacent strips each comprising two rows of pouches facing in opposite directions, to increase the production capacity of a pouch manufacturing plant. Before packaging, the multiple strip is divided into simple strips with only two rows of opposite pouches which are then divided into overlapping semi-strips, as already described above, before proceeding with their packaging.

As already previously mentioned, the method for making and filling pouches according to the present invention allows processing both pouches with spout and pouches without spout. Furthermore, in the case of pouches with spout, the insertion of the spout and its welding to the pouch can indifferently take place both at the pouch making site and at the pouch filling site, thus allowing the method of the invention to be easily adapted to the special needs of each specific user. Inserting the spout at the pouch making site has the advantage of minimizing the operations to be performed on the pouches at the pouch filling site, but it involves a significant reduction in the number of pouches per unit volume of packages, precisely due to the spout bulk. On the contrary, inserting the spout at the pouch filling site allows for high packing efficiency in the packaging of pouches without spout, with minimal additional complication of the plant at the pouch filling site to carry out the operation of inserting and welding the spout in the pouches.

When the pouches are intended to be equipped with a spout, the first embodiment of the making and filling method of the invention is particularly advantageous when inserting the spout at the pouch making site. The pouches are therefore manufactured already complete with spout and then packaged in boxes as indicated above, said pouches with spout being arranged in fact in a particularly stable and compact configuration inside the boxes. In the subsequent pouch filling step, which normally takes place in a filling site which far from the pouch making site, the two continuous semi-strips of pouches with spout facing in opposite directions are taken from the cardboard box and directly sent to the filling up machine where the pouch filling, pouch closure and pouch final mutual lateral separation (singularisation) operations take place. Each block of pouches with spout accommodated in zigzag layers in a cardboard box can thus contain several hundred pouches.

The second embodiment of the invention, instead, is particularly advantageous when inserting the spout at the filling site. In the making step, the pouches are therefore formed without spout and packaged in a roll as said above. In the subsequent filling step, the two continuous semi-strips of pouches facing in opposite directions are taken from the roll and then the operations of insertion and heat-sealing of the spouts into the pouches is implemented at an initial portion of the same filling plant, immediately upstream of the afore mentioned pouch filling up, pouch closure and pouch final cutting operations. The pouches formed without spout have the advantage that they can be packaged in a very compact roll, so that each single roll of spirally wrapped semi-strips of pouches facing in opposite directions can contain up to a few thousand pouches in a configuration which beside being compact is also particularly stable.

The method for making and filling pouches of the present invention allows therefore for a high flexibility of application in filling plants, depending on the available spaces and the volumes treated, anyhow allowing to achieve a clear reduction of a plant footprint and costs compared to integral plants, though offering the same efficiency. Compared to currently known compact plants, the manufacturing autonomy for each single block of pouches is also increased by 10 to 20 times, thus making much easier, simpler, and spaced out over time the loading of the filling up stations with packages of pouches.

Similarly to the compact plant prior art, the general scheme of the method for making and filling pouches according to the present invention, illustrated in FIG. 1, provides for its implementation in two separate steps: a first making step F wherein packages C of pouches with or without spout are manufactured, each containing a plurality of pouches, and a second filling step R wherein the pouches taken from said packages C are filled with the desired liquid product. The making step F and the filling step R are usually implemented at different sites—the first at a pouch manufacturer and the second at a manufacturer of liquid products in pouches—and are therefore separated by a transport step T of the pouch packages C between the two production sites.

The making step F includes a manufacturing sub-step F-I of the pouches P starting from two or more sheets of flexible material which are superimposed and mutually welded, and a packaging substep F-II of the pouches P in packages C. According to a first important feature of the invention, in the manufacturing sub-step F-I the pouches—instead of the traditional formats of individual pouches on rail loaders or of strips of multiple rows of pouches all facing in a same direction—are manufactured as a continuous strip S of only two rows of pouches wherein the pouches of one row are facing in an opposite direction compared with the pouches of the adjacent row, i.e., rotated by 180° in the plane of said continuous strip. The pouches are then at least partially mutually joined at their sides in contact with adjacent pouches. The position of the pouch access openings with respect to the strip is not limited in any way; however, a position facing outwards the strip is deemed preferable to facilitate the spout insertion, transport, and pouch filling operations.

In the packaging sub-step F-II the strip of pouches S is longitudinally cut into two semi-strips which are mutually superimposed and then arranged in packages C—in one or more blocks wherein the continuity of the strip S is not interrupted—said packages C being suitable for carrying out the transport step T towards the pouch filling site where the filling step R of the method of the invention is implemented.

In turn, the pouch filling step R includes a first preparation sub-step R-I, wherein the strip of pouches S is taken from the packages C and the pouches are possibly completed and prepared for the filling operation, and a singularization and filling up sub-step R-II wherein the strip S is cut into individual pouches and the individual separated pouches are fed in a per se known way to one or more filling up stations, usually of the carousel type, where both the pouch filling up and the closure of relative spout take place, or the pouch welding in case of pouches without spout. In another type of filling up stations, the singularization and filling sub-step order can be reversed and therefore the filling up can be implemented in line on the pouches still in the form of semi-strips Sd, to facilitate their transport.

In the first embodiment of the method for making pouches of the present invention, illustrated in FIGS. 2 to 5, the manufacturing sub-step F-I comprises a pair of rolls 2 of a flexible material suitable for making pouches, from which two continuous sheets 3 of said material are unrolled. The sheets 3 are brought into mutual contact inside a thermal welding machine 4, wherein the two sheets 3 are welded together to make pouches P. The thus obtained pre-welded strip passes then inside a die-cutting machine 5, where transversal cuts 6 are made between adjacent pouches P to endow the pouches P the possibility of contracting in correspondence with their side facing outwards the strip and intended to house a filling opening, such as a spout B or a simple filling port in the case of pouches without spout. When provided, the operation of insertion and heat-sealing of the spouts B in the outer edge of the pouches P is implemented in a subsequent inserting and heat-sealing device 7, from which a continuous strip S of pouches P facing in opposite directions (FIG. 2), at least partially mutually joined at their bottom portion and at their sides, comes out. Note that the transversal cuts 6 formed by the die-cutting machine 5 provide, by spreading apart, the additional material necessary to completely wrap the spouts B during the process of heat-sealing in the pouch P, without causing wrinkle formation or undesired stretching action on the flexible material of the pouches P at their upper edge.

The movement of the sheets 3 during the manufacturing substep F-I of the pouches P is preferably of a discontinuous type, with stasis times during which the above-described operations are implemented in the various workstations consisting in the welding machine 4, the die-cutting machine 5 and the device 7 for inserting and heat-sealing the spouts B.

Figures 2, 3:
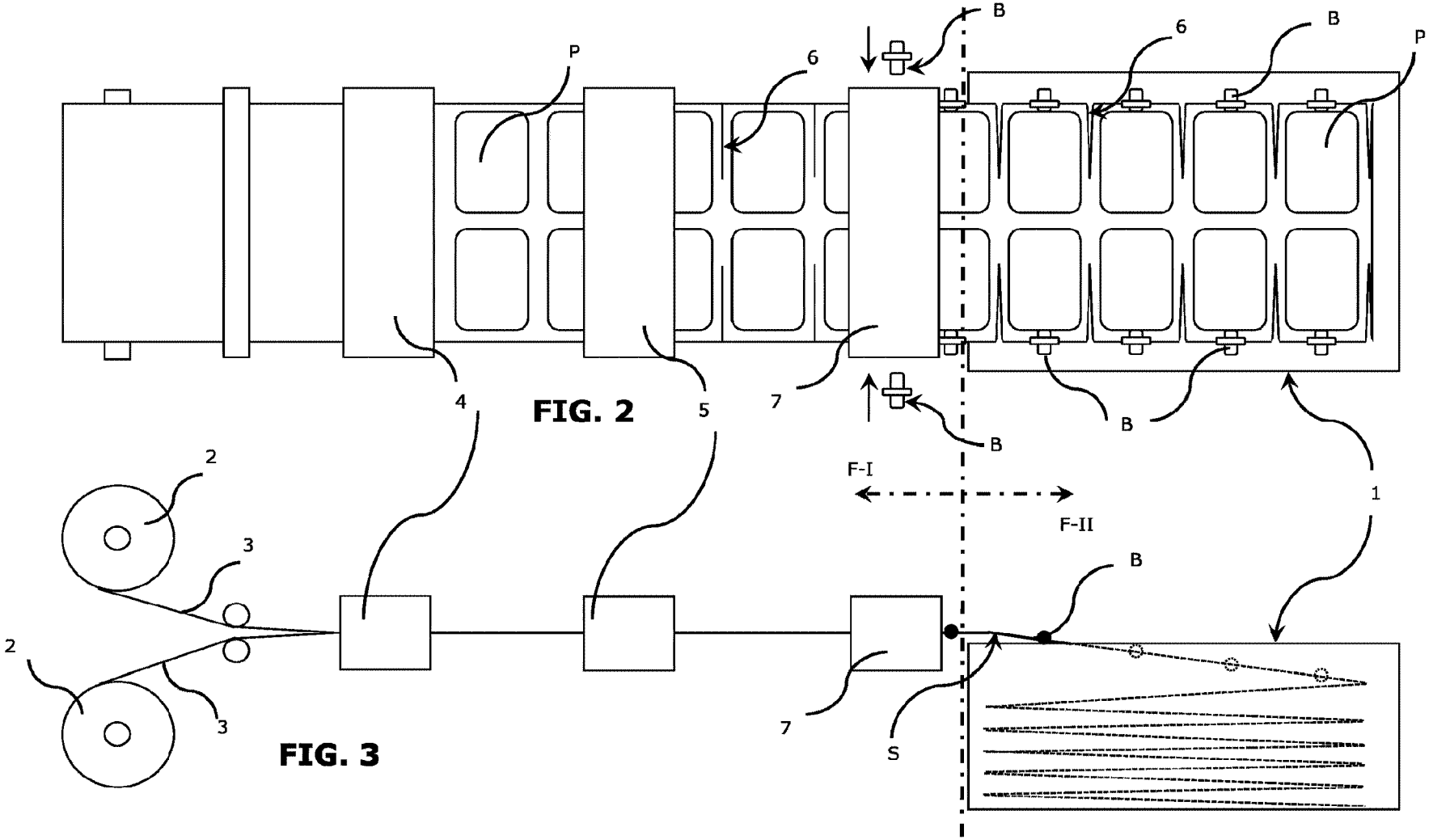
FIG. 2 is a schematic plan view of a plant for making and packaging pouches with or without spout according to the prior art, though with a configuration of the strip pouches, which is suitable for the developments of the present invention.
FIG. 3 is a schematic side elevation view of the plant of FIG. 2.
Figure 4:
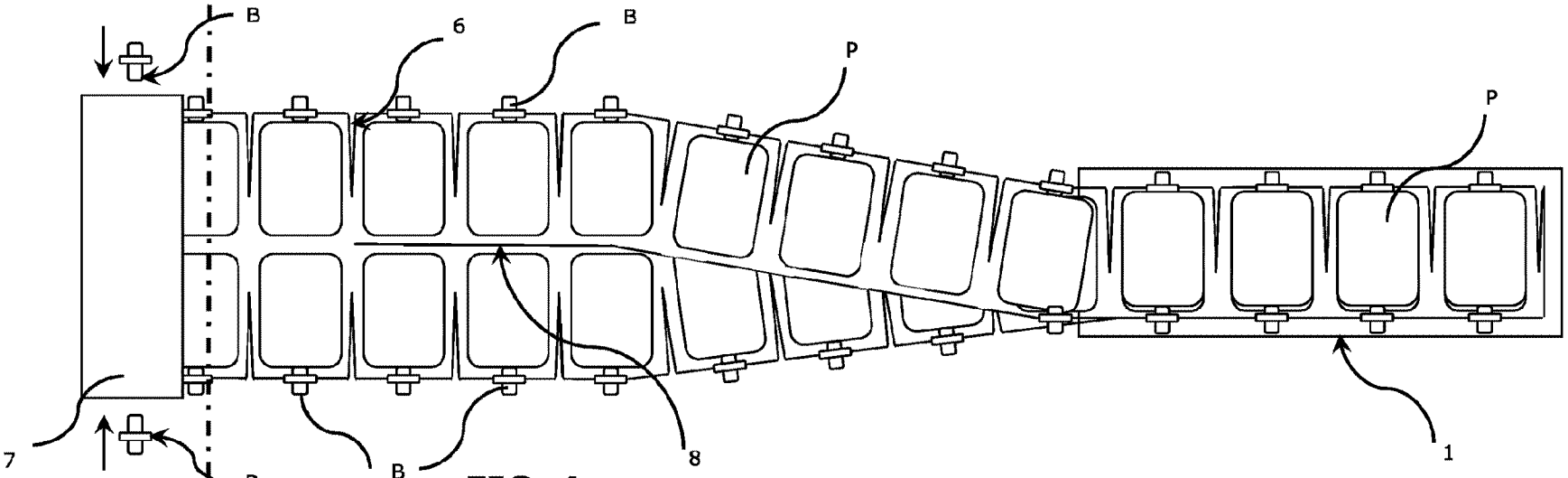
FIG. 4 is a schematic plan view of a packaging plant for pouches with or without spout, according to the present invention.
Figure 5:
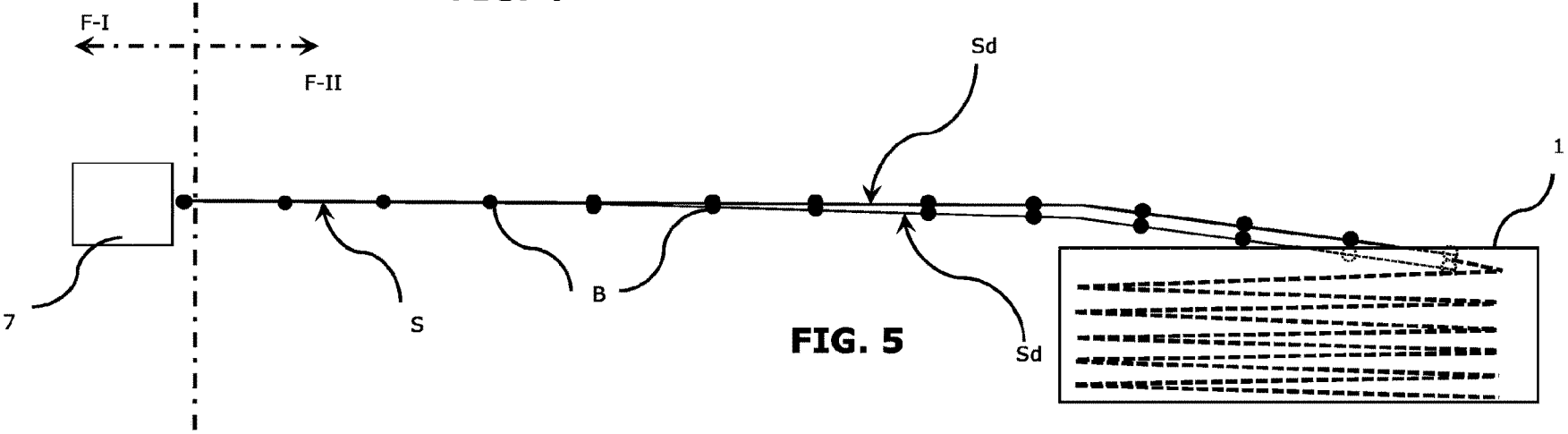
FIG. 5 is a schematic side elevation view of the plant of FIG. 4.

In the subsequent packaging sub-step F-II, instead of being directly inserted into a container 1 in successive superimposed zigzag layers as provided by the prior art and as illustrated in FIGS. 2 and 3, a longitudinal cut is preliminarily made on the strip S of pouches, along a centreline 8 of the strip S so as to make two semi-strips Sd of pouches P facing in opposite directions. The two semi-strips Sd are then deflected towards each other through appropriate guides (not illustrated) on two staggered planes, until their substantially complete overlapping is obtained, as illustrated in FIGS. 4 and 5. At this point, the two overlapping semi-strips Sd of pouches P are jointly boxed in a container 1 in zigzag superimposed double successive layers. This special packaging layout is particularly stable thanks to the symmetry of arrangement of the spouts B on opposite sides of the container 1 and to the fact that the enlarged ring of the spout B of one of two overlapped pouches P acts as a support and retention element for the edge of the bottom portion of the other one pouch P. With this special method of packaging pouches P, and thanks to the thus obtained packaging stability, the two semi-strips Sd of pouches P can be boxed either in same-measure boxes, i.e. apt to contain only a single block of pouches P, or even in larger boxes, wherein several blocks of pouches P are placed side by side, divided by simple cardboard separators. Thanks to the arrangement in opposite directions of the pouches of the two rows of pouches of strip S, any possible thicker areas of the pouches, for example such as in pouches equipped with bellows bottom portions, are also arranged symmetrically in the two superimposed semi-strips Sd, which have thus a surprisingly high dimensional stability, which is very advantageous in the subsequent transport step and filling step of the pouches P.

In the second embodiment of the method for making pouches of the present invention, the manufacturing sub-step F-I of pouches P includes the same elements already described above with respect to the first embodiment; the device 7 for inserting and heat-sealing spouts B is however preferably left out when a maximization of the number of pouches contained in each package is desired.

In this way, in fact, the strip S of opposite pouches P coming out from this sub-step F-I is completely flat, as it has no spouts B, and in the packaging sub-step F-II, after the semi-strips Sd have been longitudinally cut and overlapped they can be effectively packaged in a very compact and stable way by wrapping them on a cylindrical core, for example of pressed cardboard, to make a roll even of a considerable size.

In both the above-described embodiments, the method for making and filling pouches P of the present invention allows therefore to achieve considerable advantages in the pouch P transport step T of pouches P from the manufacturing site to the filling site and in the filling step R of pouches P. The availability of unit packages of pouches P containing hundreds/thousands of pouches P in the form of continuous and superimposed semi-strips Sd, which are very compact and stable, makes it possible to significantly simplify and accelerate the operations of transport and storage of the pouches P, and those of loading of the pouch filling up stations.

Figure 6:
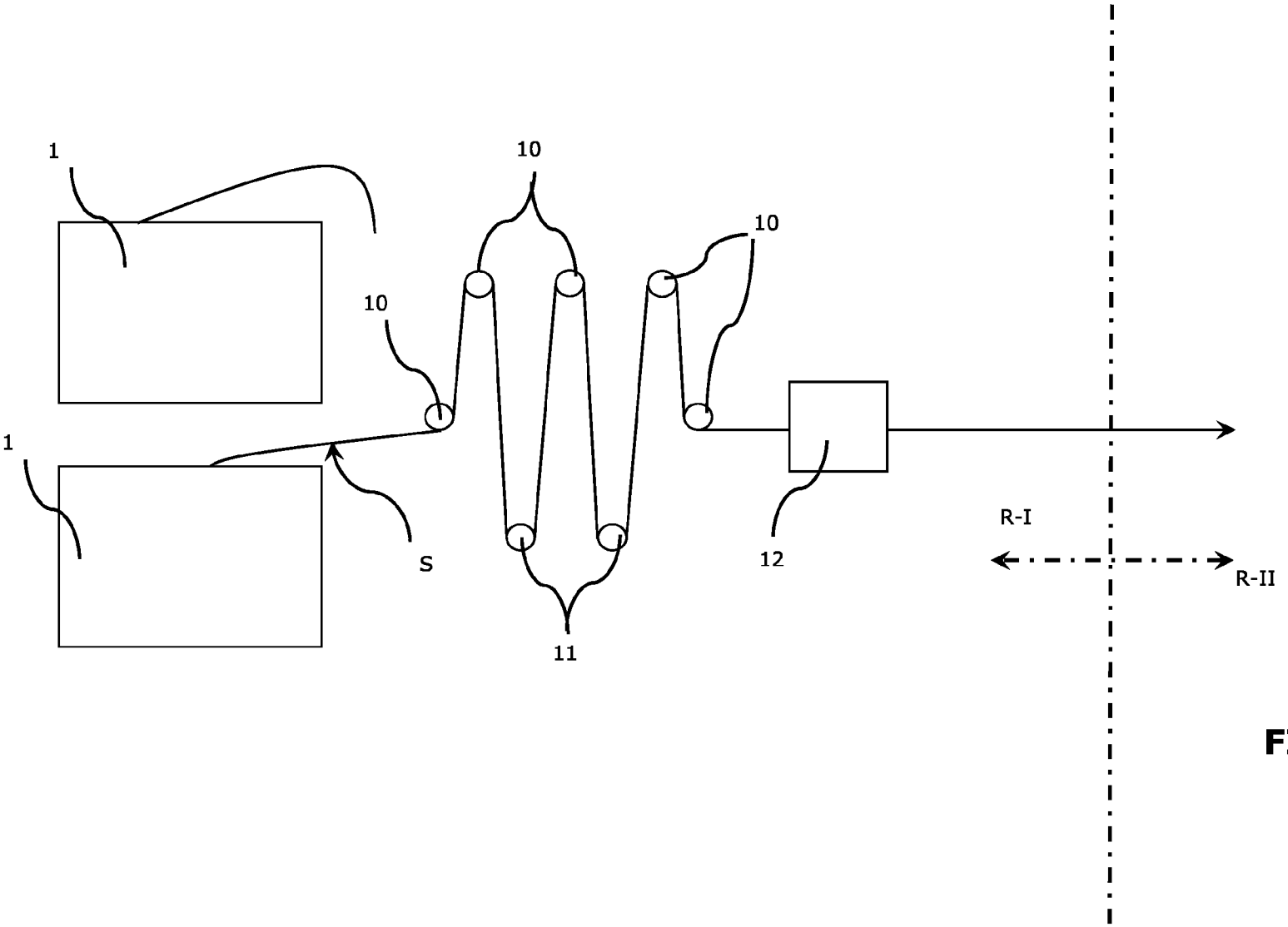
FIG. 6 is a schematic side elevation view of the pouch preparation sub-step in a filling plant for pouch with spout, fed by a zigzag folded strip of pouches.
Figure 7:
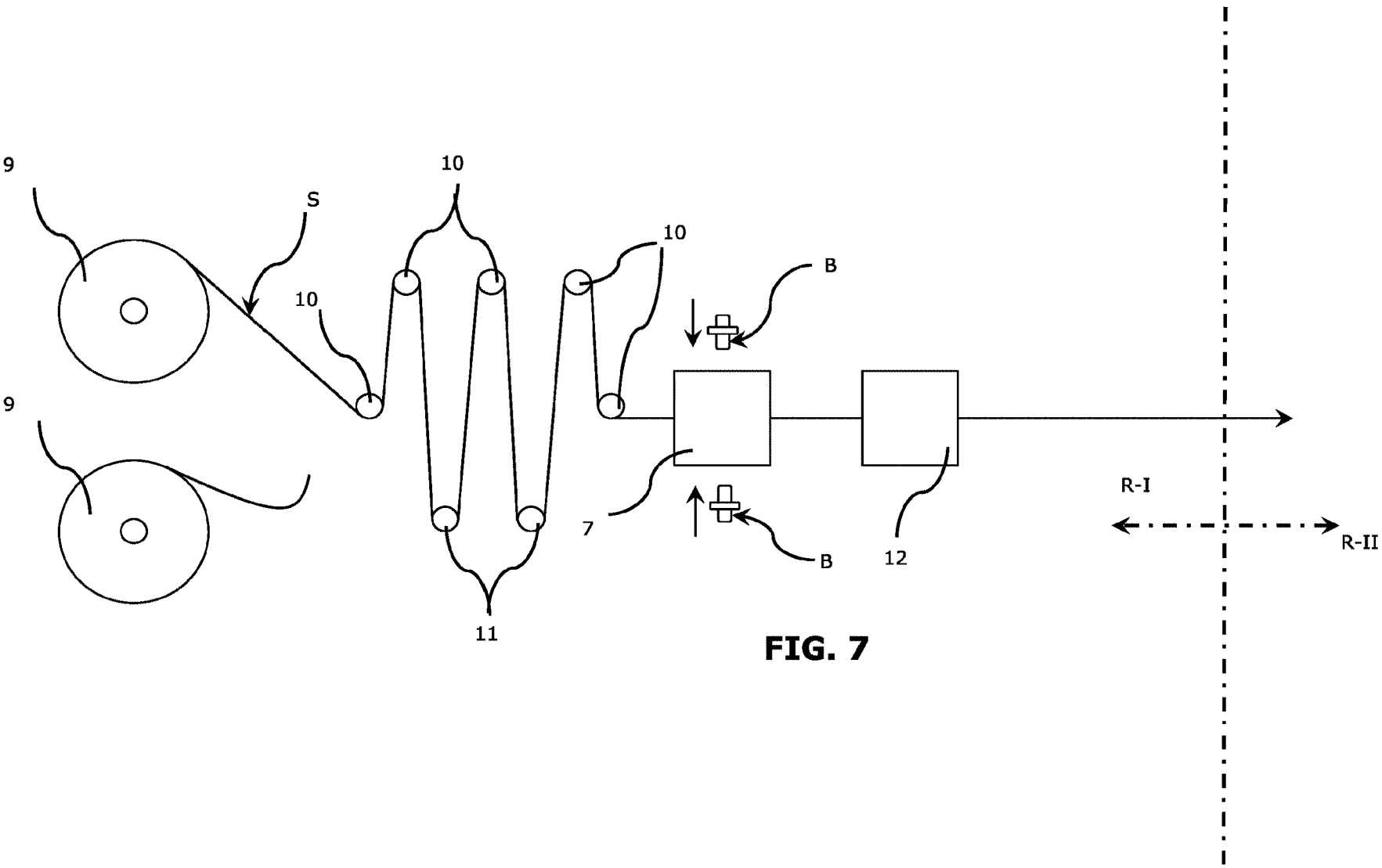
FIG. 7 is a schematic side elevation view of the pouch preparation sub-step of a filling plant of pouches without spout, fed by a roll-wrapped strip of pouches.

FIGS. 6 and 7 illustrate the preparation sub-step R-I of pouches P for the two different embodiments of the invention. In both cases, two containers 1 or two rolls 9 of semi-strips Sd of pouches P are prepared—preferably on top of each other—one of which is operational and the other one a reserve unit from which said semi-strips Sd are then unrolled. The semi-strips Sd pass then inside a continuous conveyer system equipped with opposing rolls, comprising fixed rolls 10 and dancer rolls 11, capable of maintaining a regular unwinding speed of the semi-strips Sd, despite the discontinuous operation of the singularisation and filling up sub-step R-II of pouches P. Alternatively, before inserting them into said conveyer system the two semi-strips Sd can be returned to a mutually adjacent position. In both cases, before moving to the singularization and filling up sub-step R-II, the pouches P are marked in a printer 12 with the product filling up date and expiration date. In the second embodiment of the invention, illustrated in FIG. 7, identical operations are performed except that—in the preferred version of this embodiment wherein the spouts B are not inserted in the manufacturing sub-step F-I—an inserting and heat-sealing device 7 of the spouts B is further provided upstream of the printer 12, to complete the pouch P manufacturing with the insertion and heat-sealing of said spouts B inside the pouches P.

Figure 8:
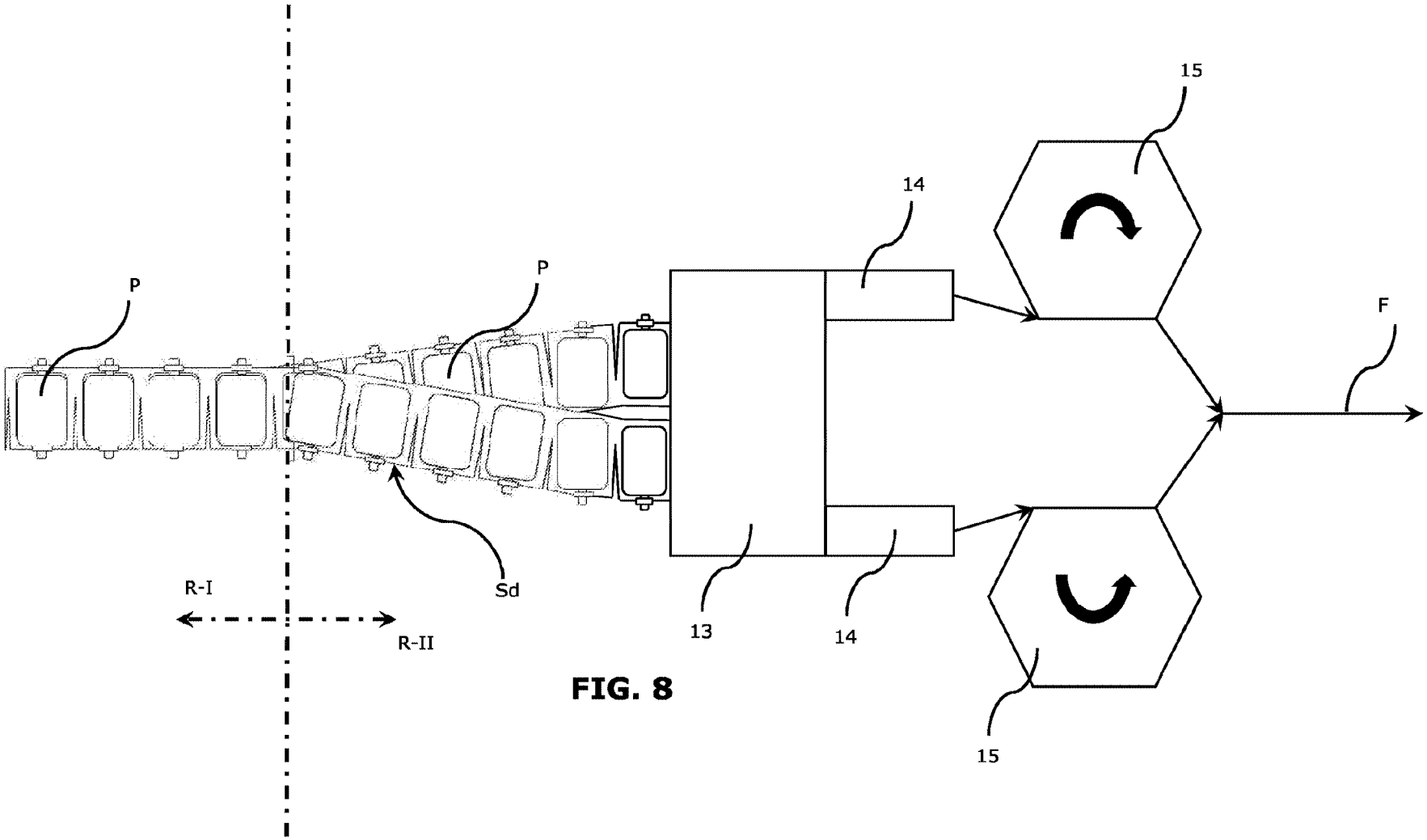
FIG. 8 is a schematic plan view of the pouch filling substep.

The singularization and filling up sub-step R-II, illustrated in FIG. 8, is identical in both embodiments of the invention and includes a cutter 13 for cutting the semi-strips Sd into individual pouches P, and two feeding devices 14 which receive the individual pouches P coming from the two semi-strips Sd, rotate them into a vertical position, and then feed them to filling up machines 15. The filling up machines 15 are preferably of the well-known per se carousel or linear type, and the filled and capped pouches P coming out therefrom are then sent to one or more packaging lines F of the finished product.

The arrangement of the various equipment described above for carrying out the singularization and filling up sub-step R-II has however been indicated by mere way of example and can also be different from that suggested, for example maintaining the integrity of the semi-strips Sd even during the filling up and capping operations, in order to facilitate the pouches P transport, and therefore carrying out the pouch singularization once they are filled, as the final step of the method of the invention.

From the previous description can be easily understood how the present invention has fully achieved the intended objects. Making the pouches P in two overlapped semi-strips Sd of pouches, in fact, allows the number of pouches P contained in a single refill package to be significantly increased, while still maintaining a high compactness and stability of the pouch P packages, and therefore to drastically simplify the management of a compact plant, i.e. a plant wherein the pouches P are produced in a making site different than their filling site. Moreover, the method of the invention can be implemented in different embodiments, namely pouches P with or without spout, packaged in zigzag layers in boxes 1 or packaged in rolls 9, thus allowing to select, for each filling site, the most suitable method in terms of overall dimensions and capacity of the refill packages.

In both cases, the flexibility and autonomy offered by the method for making and filling pouches and the related plant according to the present invention are dramatically higher than those of the methods for making and filling pouches used in traditional compact plants. Furthermore, the return problem is also eliminated, since the cardboard boxes 1 or the pressed cardboard cores of rolls 9 can be correctly disposed of and recycled together with paper, without therefore causing any management issue, in contrast to the plastic containers for individual pouches of the traditional plants. Finally, the method and plant of the invention lend themselves very well to satisfying the needs of serial filling of successive pouches each having a different drink flavour (for example fruit juices from different fruits), since the strip S can be easily arranged with repetitive series of different pouches and the plant equipped with photocell systems to recognize the beginning of each repetitive series and register it with the filling up machine.

However, it is understood that the invention should not be considered as limited to the specific arrangements of the method and plant illustrated above, which are only exemplary embodiments thereof, but that different variants are possible, all within the reach of a person skilled in the art, without thereby departing from the scope of protection of the invention itself, which is solely defined by the following claims.

The invention claimed is:

1. Method for making and filling pouches (P) with or without spout, wherein the pouch (P) making step (F) is implemented in a first site and the pouch (P) filling step (R) is implemented in a second site, a pouch (P) transport step (T) from the first site to the second site being also provided, wherein said making step (F) includes:

a manufacturing sub-step (F-I) wherein the pouches (P) are manufactured as a continuous strip (S) of multiple side-by-side rows of pouches (P); and a packaging sub-step (F-II), wherein said continuous strip (S) of multiple rows of pouches (P) is packaged in a transportable package (C), wherein said continuous strip (S) of multiple side-by-side rows of pouches (P) comprising two rows of pouches wherein the pouches (P) of one row are facing in an opposite direction compared with the pouches (P) of the adjacent row, said pouches (P) being at least partially mutually joined at their sides in contact with adjacent pouches (P), and in that at the end of said manufacturing sub-step (F-I) said strip (S) of opposing pouches (P) is cut along a centreline (8) into two semi-strips (Sd) of pouches (P) which are then deflected laterally over each other and overlapped, before being jointly sent to said packaging sub-step (F-II).

2. The method for making and filling pouches (P) with or without spout according to claim 1, wherein:

in said manufacturing sub-step (F-I) the pouches (P) of said strip (S) are equipped with a heat-sealed spout (B) or a filling port; and in said packaging sub-step (F-II) said overlapped semi-strips (Sd) of pouches (P) are arranged into a parallelepiped container (1) in successive superimposed layers, in an alternate zigzag direction.

3. The method for making and filling pouches (P) with or without spout according to claim 2, wherein said filling step (R) includes:

a preparation sub-step (R-I) wherein the two overlapped semi-strips (Sd) of pouches (P) are taken from said parallelepiped container (1) and inserted in continuous conveyer systems (10, 11); and a singularization and filling up sub-step (R-II) wherein said semi-strips (Sd) of pouches (P) are cut and divided into individual pouches (P) and each so-prepared individual pouch (P) is filled up with a predetermined amount of the desired fluid and then capped if equipped with a spout or welded if equipped with a filling port.

4. The method for making and filling pouches (P) with or without spout according to claim 1, wherein:

in said manufacturing sub-step (F-I) the pouches (P) of said strip (S) are equipped with an access opening for a spout (B) or with a filling port; and in said packaging sub-step (F-II) said overlapped semi-strips (Sd) of pouches (P) are simultaneously wrapped on a cylindrical core to form a roll (9).

5. The method for making and filling pouches (P) with or without spout according to claim 4, wherein said filling step (R) includes:

a preparation sub-step (R-I) wherein the two overlapped semi-strips (Sd) of pouches (P) are taken from said roll (9) and inserted in continuous conveyer systems (10, 11) and each of said access openings are equipped with a heat-sealed spout (B); and a singularization and filling up sub-step (R-II) wherein said semi-strips (S) of pouches (P) are cut and divided into individual pouches (P) and each individual pouch (P) is filled up with a predetermined amount of the desired fluid and then capped, if equipped with a spout, or welded, if equipped with a filling port.

6. The method for making and filling pouches (P) with or without spout according to claim 3, wherein at the end of said preparation sub-step (R-I) the pouches (P) are marked in a printer (12) with the product filling up date and expiration date.

7. Plant for making and filling pouches (P) with or without spout, wherein the pouch (P) making (F) is implemented in a first site and the pouch (P) filling (R) is implemented in a second site, where said making plant includes:

a. a thermal welding machine (4) and a die-cutting machine (5) in line, fed upstream by two or more sheets (3) of flexible material to produce a continuous strip (S) of multiple rows of pouches (P) placed side by side; and b. a packaging device, for packaging said continuous strip (S) of pouches (P) in a transportable package (C);

wherein said continuous strip (S) of multiple side-by-side rows of pouches (P) comprises two rows of pouches wherein the pouches (P) of one row are facing in an opposite direction compared with the pouches (P) of the adjacent row, said pouches (P) being at least partially mutually joined at their sides in contact with adjacent pouches (P), and in that at the end of the manufacturing of said strip (S) of pouches (P) facing in opposite directions a cutting device is provided which cuts said strip (S) along its centreline (8) into two semi-strips (Sd) of pouches (P), and a guiding device which diverts the two semi-strips (Sd) laterally over each other until their complete overlapping is determined, upstream of said packaging device.

8. The plant for making and filling pouches (P) with or without spout according to claim 7, further comprising a device for inserting and heat-sealing (7) spouts (B) on one side of said pouches (P), wherein said packaging device arranges said continuous semi-strips (Sd) of pouches (P) facing in opposite directions, into a parallelepiped container (1) in successive superimposed layers, in an alternate zigzag direction.

9. The plant for making and filling pouches (P) with or without spout according to claim 7, wherein said filling plant includes:

a. a continuous conveyer system of the semi-strips (Sd) taken from said parallelepiped container (1), provided with opposing rolls comprising fixed rolls (10) and dancer rolls (11);

b. a printer (12) to mark each pouch (P) with the product filling up date and expiration date;

c. a cutter (13) to cut the strip (S) into individual pouches (P); and d. feeding devices (14) to receive the individual pouches (P) coming from the two semi-strips (Sd), rotate them into a vertical position and then feed them to filling up machines (15) where the pouches (P) are filled-up and capped.

10. The plant for making and filling pouches (P) with or without spout according to claim 7, wherein said packaging device wraps said continuous semi-strips (Sd) of pouches (P) on a cylindrical core to form a roll (9).

11. The plant for making and filling pouches (P) with or without spout according to claim 10, wherein said filling plant includes:

a. a continuous conveyer system of the semi-strips (S) taken from said roll (9), provided with opposing rolls comprising fixed rolls (10) and dancer rolls (11);

b. a device for inserting and heat-sealing (7) spouts (B) on one side of said pouches (P);

c. a printer (12) to mark each pouch (P) with the product filling up date and expiration date;

d. a cutter (13) to cut the semi-strips (Sd) into individual pouches (P); and e. feeding devices (14) to receive the individual pouches (P) coming from the two semi-strips (Sd), rotate them into a vertical position and then feed them to filling up machines (15) where the pouches (P) are filled-up and capped.

12. The plant for making and filling pouches (P) with or without spout according to claim 9, wherein said filling up machine (15) is of the carousel type.

13. The plant for making and filling pouches (P) with or without spout according to claim 9, wherein said filling up machine is of the linear type.

* * * * *